US007397904B2

(12) United States Patent
Virshup et al.

(10) Patent No.: US 7,397,904 B2
(45) Date of Patent: Jul. 8, 2008

(54) ASYMMETRIC FLATTENING FILTER FOR X-RAY DEVICE

(75) Inventors: Gary Virshup, Cupertino, CA (US); James Boye, Salt Lake City, UT (US); Edward J. Seppi, Portola Valley, CA (US); Heinrich Riem, Wettingen (CH); Govin Dasani, Epsom (GB); Edward Shapiro, Menlo Park, CA (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 0 days.

(21) Appl. No.: 11/127,343

(22) Filed: May 11, 2005

(65) Prior Publication Data

US 2006/0256925 A1 Nov. 16, 2006

(51) Int. Cl.
*G21K 3/00* (2006.01)

(52) U.S. Cl. ..... 378/156; 378/158; 378/159

(58) Field of Classification Search ..... 378/119, 378/156–161

See application file for complete search history.

(56) References Cited

U.S. PATENT DOCUMENTS 3,610,984 A 10/1971 Seki et al.
3,755,672 A * 8/1973 Edholm et al. ..... 378/158
3,854,049 A 12/1974 Mistretta et al.
3,917,954 A * 11/1975 Boge ..... 378/159
4,101,766 A * 7/1978 Minami et al. ..... 378/158
4,359,642 A * 11/1982 Heinz et al. ..... 378/150
4,433,431 A 2/1984 Pfeiler
4,481,419 A * 11/1984 Persyk ..... 250/363.06
4,731,807 A 3/1988 Plessis et al.
4,859,849 A 8/1989 Shimura et al.
4,933,960 A 6/1990 Fujisaki
5,446,548 A 8/1995 Gerig et al.
5,568,533 A * 10/1996 Kumazaki et al. ..... 378/156
6,333,991 B1 12/2001 Schreiber et al.
6,418,193 B1 7/2002 Albagli
6,473,634 B1 10/2002 Barni
6,487,274 B2 11/2002 Bertsche
6,614,878 B2 9/2003 Bogatu et al.

(Continued)

OTHER PUBLICATIONS

U.S. Appl. No. 10/687,573, filed Oct. 15, 2003, Seppi et al.

(Continued)

*Primary Examiner*—Irakli Kikanadze
(74) *Attorney, Agent, or Firm*—Workman Nydegger

(57) ABSTRACT

Devices and methods for implementing selective, or asymmetric, attenuation of an x-ray beam. In one example, a filter is provided that is substantially in the form of a wedge where some portions of the filter are thicker, and thus provide greater attenuation, than other, thinner portions of the filter. The filter is situated between the target surface of the anode and the x-ray subject so that x-rays generated by the target pass through the filter before reaching the x-ray subject. Specifically, the filter is oriented so that the thicker portion of the filter receives the higher intensity portion of the x-ray beam, while the thinner portion of the filter receives the relatively lower intensity portion of the x-ray beam. Thus, the gain profile of the x-ray beam is flattened so that the intensity, or flux, of the x-ray beam is relatively uniform throughout a substantial portion of the beam profile.

17 Claims, 8 Drawing Sheets

U.S. PATENT DOCUMENTS

| | | | | |
|---|---|---|---|---|
| 6,950,493 | B2 | 9/2005 | Besson | |
| 6,968,042 | B2 * | 11/2005 | Toth et al. | 378/156 |
| 2004/0247082 | A1 | 12/2004 | Hoffman | |
| 2005/0058254 | A1 * | 3/2005 | Toth et al. | 378/156 |

OTHER PUBLICATIONS

James L. Robar et al.; "Tumour dose enhancement using modified megavoltage photon beams and contrast media"; Institute of Physics Publishing; Feb. 5, 2002; pp. 1-18.

* cited by examiner

ASYMMETRIC FLATTENING FILTER FOR X-RAY DEVICE

RELATED APPLICATIONS

Not applicable.

BACKGROUND OF THE INVENTION

1. Field of the Invention

The present invention relates generally to x-ray systems, devices, and related components. More particularly, exemplary embodiments of the invention concern devices and methods that enhance x-ray flux uniformity and thus contribute to; an improved signal-to-noise ratio and increased dynamic range in the x-ray imaging device.

2. Related Technology

The ability to consistently develop high quality radiographic images is an important element in the usefulness and effectiveness of x-ray imaging devices as diagnostic tools. However, various problems and shortcomings relating to the design, construction and/or operation of the x-ray device often act to materially compromise the quality of radiographic images generated by the device. One problem commonly encountered in x-ray devices is the occurrence of undesirable variation in the intensity, or flux, of x-rays produced by the target. Such variations in x-ray intensity often cause visible differences in the image density of the radiographs, thereby impairing the quality and usefulness of the image. As discussed below, this lack of flux uniformity is due at least in part to anode geometry and other related considerations.

In typical x-ray tubes, x-rays are produced when an electron beam generated by the cathode is directed to a target surface or a target track, composed of a refractory metal such as tungsten, of an associated anode. In many instances, the electron beam penetrates the target surface. Such penetration of the target surface usually occurs when the target surface is worn and/or has other irregularities, but can occur under other circumstances as well.

In general, when x-rays are generated below the target surface, such x-rays typically take a variety of different paths through the target material to the x-ray subject. Because some of such paths are relatively longer than others, the anode material imparts a filtering effect to, or attenuates, the generated x-rays and so that the photon fluence and the spectral distribution are thereby affected. This phenomenon is sometimes referred to as the "heel effect."

One particular consequence of the heel effect with respect to the x-ray beam is that the mean energy of the x-ray spectrum is relatively higher in some areas of the x-ray beam than in others. While this effect is cause for concern in a variety of different type of x-ray tube configurations, the heel effect is particularly acute in rotating anode type tubes since the targets employed in such tubes have relatively small angles, some as low as about 7 degrees. Cone beam computed tomography ("CBCT") devices and processes are particularly susceptible.

As suggested above, the anode geometry, and the geometry of the target track in particular, plays a role in producing the heel effect whereby x-rays that are required to travel relatively further through the target track will experience a relatively greater degree of attenuation than x-rays traveling a relatively shorter distance through the target track. More particularly, the distance traveled by the x-ray through the target track is largely a function of the takeoff angle of the x-ray, or the angle of the travel path of the emitted x-ray with respect to a reference axis, such as an axis parallel to the target surface. Thus, a relatively smaller takeoff angle corresponds to a relatively shorter distance for the x-ray to travel through the target track, while a relatively larger takeoff angle corresponds to a relatively longer distance traveled through the target track material. This relationship, and the relative magnitude of the resulting effects, can be considered in terms of the relation of the takeoff angle of the x-ray to the track angle of the anode.

In particular, as the takeoff angle approaches the track angle, the travel path of the x-ray moves closer to a parallel orientation with respect to the target surface. Consequently, the degree of attenuation experienced by any particular x-ray increases as the takeoff angle of the x-ray approaches the track angle. This is readily illustrated by consideration of the end conditions where an x-ray travels either parallel or perpendicular to the target surface. In particular, an x-ray traveling parallel to the target surface travels a greater distance through the target material than an x-ray traveling perpendicular to the target surface.

Such variations in attenuation imposed on the x-rays by the target track material results in a lack of flux uniformity in the x-ray beam. It is often the case that the flux, or intensity is relatively, higher at the center of the x-ray beam and relatively lower along the edges or peripheral portions of the x-ray beam. While irregularities in flux uniformity are often attributable to considerations such as the anode geometry and the condition of the anode, flux variations may be a function of other variables as well. For example, the distance between the x-ray beam source and the imaging plane may also play a role in the relative uniformity of the flux associated with an x-ray device.

It was noted earlier that a lack of uniform flux in the x-ray beam implicates a variety of different problems. For example, nonuniform flux contributes to unacceptably high signal-to-noise ratios ("SNR"). In particular, the signal, or usable portion, of the x-ray beam is smaller relative to the noise, or unusable portion, of the x-ray beam, than might otherwise be the case. Thus, the portion of the x-ray beam that can be effectively employed in radiographic imaging processes is reduced.

Another concern relates to the impact that nonuniform flux has with respect to a dynamic range of an imager. In particular, to the extent that the flux varies over the imager, the dose available to the edges of the detectors is reduced relative to the dose available elsewhere and, thus, the dynamic range of the imager is correspondingly impaired.

In recognition of these, and other problems, attempts have been made to overcome the problems flowing from the influence of the heel effect. One such attempt involves the calibration of a flat panel imager. Generally, this attempt is a software implemented approach that involves exposing the flat panel imager to an x-ray flux and compensating gains for each pixel based upon a combination of the dose to, and response of, each pixel. If a dose to a particular pixel is reduced, the gain for that pixel is increased. By performing this process repeatedly, the gain of the unattenuated x-ray beam can be flattened somewhat.

This calibration process thus represents somewhat of an after-the-fact approach to nonuniform flux. In particular, this approach concentrates on modifying a response of the imager to the unattenuated x-ray beam, rather than performing any attenuation process on the x-ray beam itself.

The flat panel imager calibration process is largely directed to calibration of imager gain, but does little or nothing to reduce the overall dynamic gain of the x-ray system. Further, the calibration process can be time consuming.

In view of the foregoing, and other, problems in the art, it would be useful to provide methods and devices that, among other things, implement selective attenuation of an x-ray beam so as to aid in overcoming the heel effect, and other phenomena, and thus contribute to a relative improvement in flux uniformity of the x-ray beam.

BRIEF SUMMARY OF AN EXEMPLARY EMBODIMENT OF THE INVENTION

In general, embodiments of the invention are concerned with devices and methods for implementing selective attenuation of an x-ray beam so as to aid in overcoming the heel effect, and other phenomena, and thus contribute to a relative improvement in flux uniformity of the x-ray beam.

In one exemplary implementation, a filter is provided that comprises various different attenuation portions, each of which has different respective attenuation characteristics. In this example, the filter is substantially in the form of a wedge so that some portions of the filter are thicker, and thus provide greater attenuation, than other, thinner portions of the filter.

In operation, the filter is situated between the target surface of the anode and the x-ray subject so that x-rays generated by the target surface pass through the filter before reaching the x-ray subject. More particularly, the filter is oriented so that the thicker portion of the filter receives the higher intensity portion of the x-ray beam, while the thinner portion of the filter receives the relatively lower intensity portion of the x-ray beam.

In this way, the gain profile of the x-ray beam is flattened so that the intensity, or flux, of the x-ray beam is relatively uniform throughout a substantial portion of the beam profile. Such flux uniformity, in turn, improves the SNR of the imager, and contributes to an increase in the dynamic range of the imager, among other things.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF EXEMPLARY EMBODIMENTS OF THE INVENTION

Reference will now be made to the drawings to describe various aspects of exemplary embodiments of the invention. It should be understood that the drawings are diagrammatic and schematic representations of such exemplary embodiments and, accordingly, are not limiting of the scope of the present invention, nor are the drawings necessarily drawn to scale.

Generally, embodiments of the invention concern devices and methods for implementing selective attenuation of an x-ray beam so as to aid in overcoming the heel effect, and other phenomena, and thus contribute to a relative improvement in flux uniformity of the x-ray beam. In one implementation, an asymmetric flattening filter is provided that comprises various different attenuation portions, each of has different respective attenuation characteristics. As used herein, "asymmetric" refers both to the fact that the filter attenuates some portions of the x-ray beam to a relatively greater extent than other portions of the x-ray beam, as well as to the fact that the filter, correspondingly, may be implemented with an asymmetric geometry. Thus, the asymmetric flattening filter is exemplarily implemented substantially in the form of a wedge so that some portions of the asymmetric flattening filter are thicker, and thus provide greater attenuation, than other, thinner portions of the asymmetric flattening filter.

As disclosed herein, the asymmetric flattening filter is positioned so as to place specific portions of the geometry of the asymmetric flattening filter in desired orientations relative to corresponding portions of the intensity profile of the x-ray beam. In one particular implementation, the relatively thicker portion of the asymmetric flattening filter is positioned to receive a relatively higher intensity portion of the x-ray beam, while the relatively thinner portion of the asymmetric flattening filter is positioned to receive a relatively lower intensity portion of the x-ray beam. By selectively attenuating the x-ray beam in this way, a relatively flat gain can be achieved across a substantial portion of the beam profile.

I. Target Geometry and the Heel Effect

As disclosed elsewhere herein, the "heel effect" comes about when x-rays are generated below a target surface take a variety of different paths through the target material to the x-ray subject. In particular, because some of such paths are relatively longer than others, the anode material acts to attenuate the x-ray beam so that the photon fluence and the spectral distribution of the x-ray beam are thereby affected.

Figure 1:
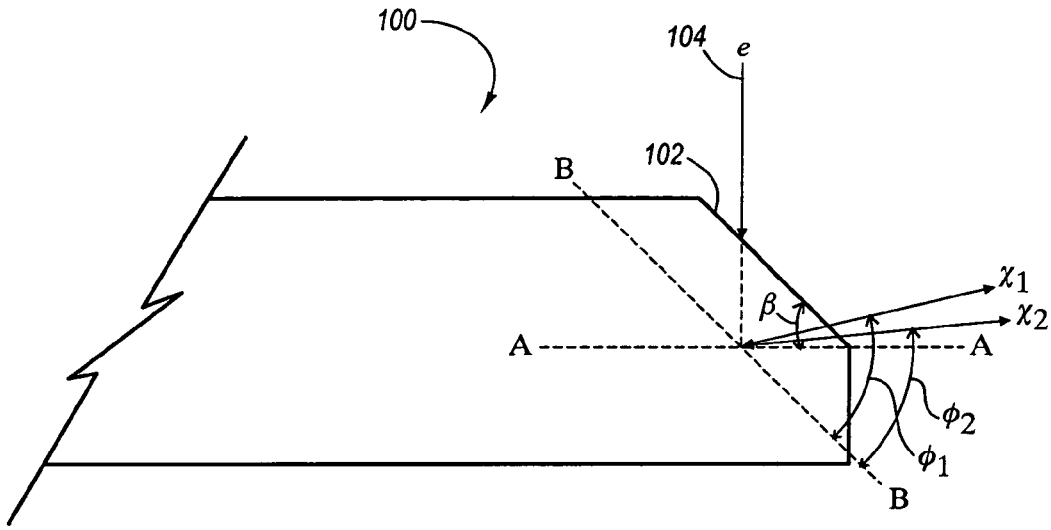
FIG. 1 is schematic view illustrating an exemplary anode geometry as it relates to occurrence of the heel effect.

With particular attention now to FIG. 1, details are provided concerning the geometry of an anode 100 as such geometry relates to the heel effect and other phenomena. In the arrangement illustrated in FIG. 1, the anode 100 that is illustrated is a rotating type anode. However, the scope of the invention is not so limited and, more generally, the filter method and devices disclosed herein may be used in connection with any of a variety of types of different types of x-ray devices.

With particular reference to the exemplary anode 100, a target surface 102, also referred to herein as a target or target track, is provided that is configured and arranged to receive an electron beam 104 (the electron beam is typically vertical) from a cathode (not shown). The thickness, and other aspects of the geometry of the target 102, may be selected as necessary to suit the requirements of particular application. Exemplarily, the target 102 comprises a refractory metal such as tungsten. However, any other materials effective in the generation of x-rays may alternatively be employed. Examples of alternative target materials include, but are not limited to, tungsten-rhenium compounds, molybdenum, copper, or any other x-ray producing material.

In case of the illustrated embodiment of the anode 100, the target surface 102 defines a track angle $\beta$ relative to a reference plane AA. The track angle $\beta$ is selected and implemented according to the requirements of a particular application and/or operating environment, and the scope of the invention should not be construed to be limited to any particular anode 100 geometry or any particular track angle(s) $\beta$.

In operation, the electron beam 104 impacts the target 102 at a substantially perpendicular orientation relative to reference plane AA. In other cases, the orientation of the electron beam 104 may be different. As a result of the interaction of the electrons in the electron beam 104 with the shell structure of the metal that comprises the target 102, x-rays, denoted schematically at $X_1$ and $X_2$, are emitted through the target 102. As indicated in FIG. 1, the x-rays $X_1$ and $X_2$ typically exit the target surface 102 in a variety of orientations. One convenient way to describe this phenomenon is with reference to the takeoff angle of a particular x-ray. In general, the takeoff angle refers to an angle collectively defined by the travel path of the x-ray relative to a predetermined axis or plane, such as plane BB for example. In the illustrated embodiment, the plane BB is substantially parallel to the surface of the target 102.

As can be seen in FIG. 1, the x-ray denoted $X_1$ has a takeoff angle $\phi_1$, while the x-ray denoted at $X_2$ has a takeoff angle denoted $\phi_2$. As further evident from FIG. 1, the distance traveled by x-ray $X_1$ through the target 102 is relatively shorter than the distance traveled by x-ray denoted $X_2$ through the target 102. Thus, a relatively larger takeoff angle, such as $\phi_1$, corresponds to a relatively shorter travel path of the corresponding x-ray through the target 102. Further, an x-ray with a relatively longer travel path through the target 102 experiences a relatively higher degree of attenuation as a result of having past through greater portion of the target 102 than would be experienced by an x-ray with a relatively smaller takeoff angle and, thus, a relatively longer travel path 102. This phenomenon is sometimes referred to as the heel effect.

Because the given x-ray loses intensity, or becomes attenuated, in proportion to the distance that the x-ray travels through the target 102, the resulting x-ray beam, collectively comprising $X_1$ and $X_2$ in the illustrated example, has a beam profile with areas of varying intensity. This intensity is also some times referred to as the flux of the x-ray beam. As disclosed elsewhere herein, it is useful to be able to produce a x-ray beam of a substantially uniform flux, so that a substantially flat gain can be achieved. Directing attention now to FIG. 2, details are provided concerning some exemplary gain profiles, with particular emphasis on the change in gain profile that may be achieved through the use of methods and devices such as those disclosed herein.

By way of example, the $MAX_1$-$MIN_1$ curve represents a situation where the intensity of the x-ray beam varies by an amount $\Delta_1$ from the center to the periphery of the x-ray beam when no attenuation method or device is employed. By way of comparison, the curve collectively defined by $MAX_2$-$MIN_2$ shows a significantly smaller variation $\Delta_2$ between the intensity at the center of the beam relative to the intensity on the periphery of the x-ray beam.

Thus, the $MAX_2$-$MIN_2$ curve is relatively flatter, or experiences less overall variation, than the $MAX_1$-$MIN_1$ curve, with the $MAX_2$-$MIN_2$ schematically representing an exemplary gain profile such as may be achieved through the employment of methods and devices of the invention. In particular, it can be seen that the maximum variation in intensity, denoted at $\Delta_2$, is substantially less than the maximum variation in intensity $\Delta_1$, so that a relatively flatter gain profile and flux uniformity are represented by $MAX_2$-$MIN_2$. Such asymmetric flattening can also be thought of in terms of a relative increase in attenuation to the high fluence regions of the x-ray beam, and a relative reduction to lower fluence regions of the x-ray beam.

Figure 2:
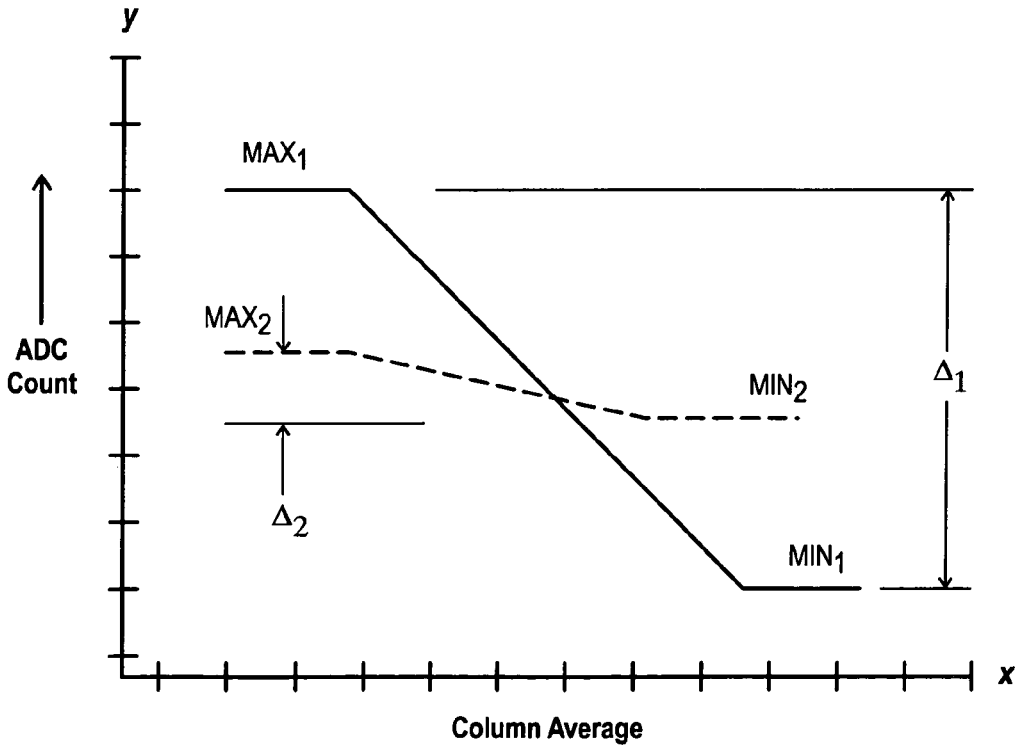
FIG. 2 is a simplified graph showing various exemplary gain profiles associated with an x-ray device.

Through the use of the asymmetric flatting filters and associated methods disclosed herein, achievement of relatively flat gain profiles, exemplified by the $MAX_2$-$MIN_2$ curve of FIG. 2, can be readily obtained. Among other things, the attainment of improved flux uniformity in this way increases the dynamic range of flat panel imagers by increasing the available dose to the edges of the corresponding detectors. As well, the improvement in flux uniformity also increases the signal to noise ratio ("SNR") associated with the imager.

II. Exemplary Operating Environments

Figure 3:
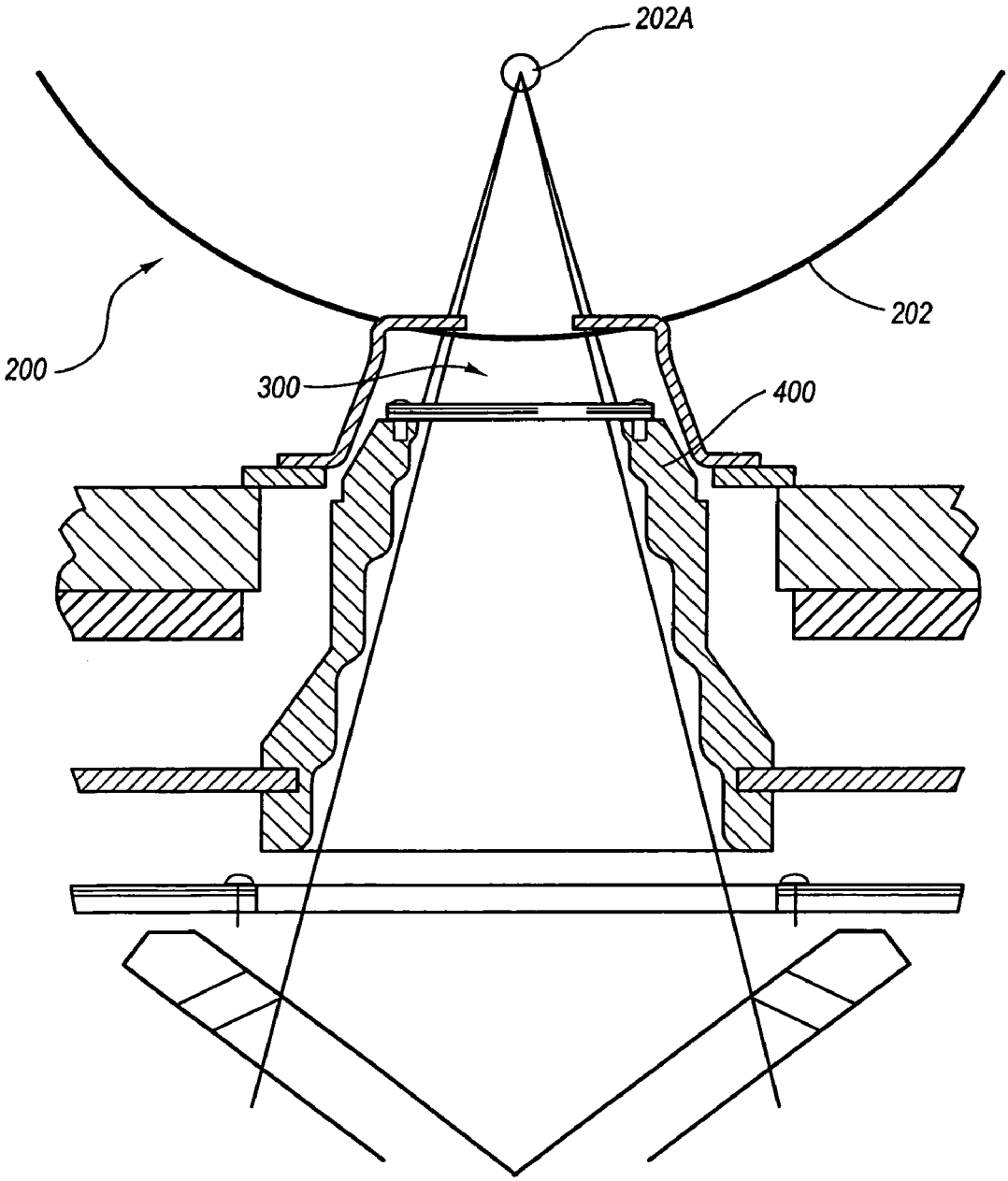
FIG. 3 is a section view that illustrates selected aspects of an exemplary x-ray device wherein an asymmetric flattening filter may be usefully employed.

As suggested elsewhere herein, asymmetric attenuation of an x-ray beam with the devices and methods of the invention can be achieved in a variety of different operating environments. With attention now to FIG. 3, details are provided concerning selected aspects of one exemplary operating environment from embodiments of the invention. In particular, an x-ray device 200 is illustrated that includes a tube 202 with an x-ray beam source 202*a* configured and arranged to generate an x-ray beam that is passed to a filter 300 positioned on a support structure 400. In general, the x-ray beam generated by the tube 202 passes through the filter 300 which attenuates the x-ray beam so as to achieve predetermined affect, and then passes the x-ray beam to an x-ray subject (not shown).

Methods and devices such as the filter 300 disclosed herein may be employed in a variety of different operating environments. In some cases, embodiments of the filter 300 are suitable for employment in connection with flat panel imager devices. However, the scope of the invention is not so limited. Instead, embodiments of the invention may be employed in any other operating environment where the functionality and characteristics disclosed herein may usefully be employed.

III. Aspects of Exemplary Attenuating Filters

Directing attention now to FIGS. 4A through 7B, details are provided concerning aspects of a variety of exemplary embodiments of an asymmetric flattening filter. It should be noted that the various exemplary filters disclosed herein constitute exemplary structural implementations of a means for selectively attenuating an x-ray beam. However, the scope of the invention should not be construed to be limited to such exemplary filters. Rather, any other structure(s) capable of implementing comparable functionality is/are considered to be within the scope of the invention.

Figure 4B:
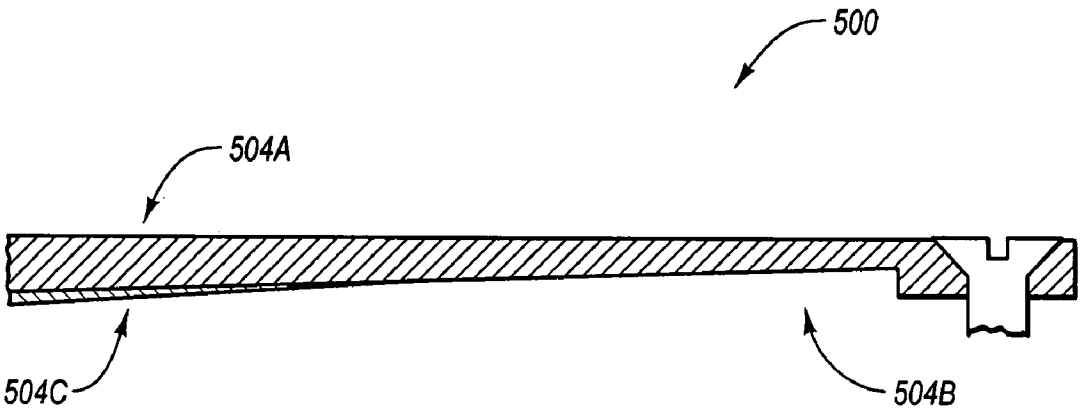
FIG. 4B is a partial section view of the asymmetric flattening filter illustrated in FIG. 4A.
Figure 4A:
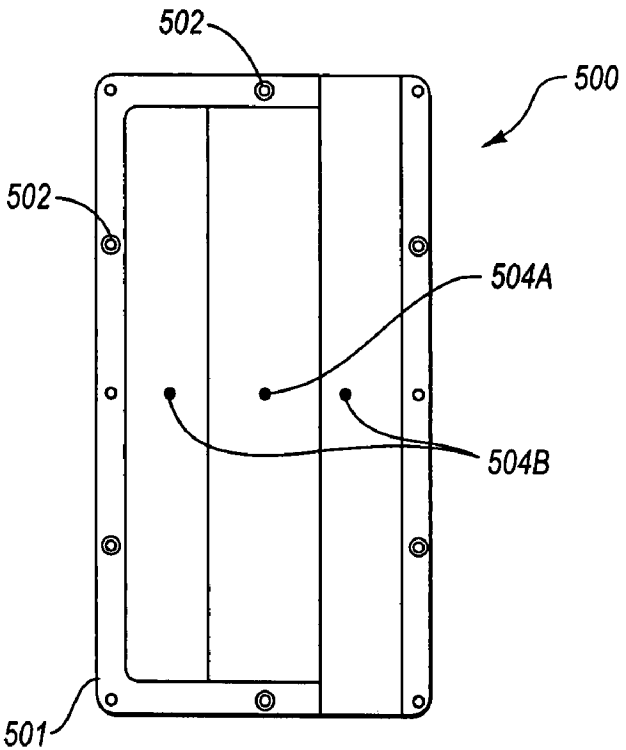
FIG. 4A is a top view of an exemplary asymmetric flattening filter.

With particular attention first to FIGS. 4A and 4B, a filter 500 is disclosed that is substantially polygonal, exemplarily rectangular, and defines or otherwise includes a mounting structure 501 having a plurality of fastener holes 502 to aid in attachment of the filter 500 to a suitable support structure. While the overall shape of the exemplary filter 500 is substantially rectangular, the particular dimensions of the filters 500 depend on a variety of variables including, but not limited to, the distance between the filter and the focal spot of the associated x-ray device. In one exemplary implementation, the filter 500 is rectangular in form and has dimensions of about 10 centimeters×about 20 centimeters, which generally correspond to a distance between the filter and the focal spot of about 40 centimeters. More generally however, the geometry of the filter 500, and other exemplary filters disclosed herein, is not limited to any particular configuration, and aspects of the geometry of the filter may be varied as necessary to suit the requirements of a particular application.

As indicated in the half section view of FIG. 4B, the exemplary filter 500 includes an attenuation portion 504A, embodied as a relatively thicker middle section, that tapers to an attenuation portion 504B that, in the illustrated embodiment, takes the form of a pair of relatively thinner subsidiary attenuation portions disposed on either side of the attenuation portion 504A. Thus, the exemplary filter 500 comprises a variety of different attenuation portions, each of which has particular attenuation characteristics which can be used to produce a desired affect with respect to a specified portion of an x-ray beam when the filter 500 is positioned within an x-ray device.

In the particular arrangement illustrated in FIGS. 4A and 4B, the configuration and arrangement of the attenuation portions 504A and 504B results in a filter 500 having a substantially wedge shaped half cross-section, as best illustrated in FIG. 4B. However, the scope of the invention is not so limited and various other configurations may alternatively be employed. Moreover, wedge type configurations examples of which are illustrated in FIGS. 4*a* and 4*b*, can varied as desired. For example, FIG. 4B indicates a wedge configuration that is substantially linear from the thick portion 504A to the thin portion 504B. However, it may be useful in some situations to provide a filter configuration with a nonlinear slope, or alternatively, a filter having a slope configuration that includes both linear, and nonlinear portions. More generally, however, and as suggested above, the filter 500 can be constructed in any form or manner necessary to aid in the achievement of a desired attenuation effect, or effects, with respect to an x-ray beam.

With continuing attention to FIG. 4B, the illustrated filter 500 further includes a supplemental attenuation portion 504C disposed proximate the attenuation portion 504A of the filter 500. In one exemplary implementation, the supplemental attenuation portion 504C describes an arc of about 2.13 degrees. However, this particular configuration is exemplary only and is not intended to limit the scope of the invention in any way.

It should be noted with respect to the construction of the filter 500, some embodiments of the filter 500 provide for an integral, or one piece, construction. In yet other cases however, the filter 500 comprises a plurality of different portions attached together by any suitable process, examples of which include welding and brazing. The same is likewise true with respect to the various other exemplary filters disclosed herein. Further, such filters may be formed by any suitable process, examples of which include machining, milling, casting or combinations thereof.

As noted above, the geometry of a particular filter may be selected and informed by a variety of different considerations. In some cases, such considerations relate to the nature of the intended application of the filter and associated x-ray device. For example, both the FDA and EEC have promulgated regulations that require filtration of x-ray beams in order to harden the beams to the extent necessary to protect the skin and other organs of a human patient. In some cases, an aluminum filter with a minimum thickness of 2 millimeters satisfies such requirements. Of course, because some of the x-rays generated by an x-ray device employing such a filter have already been partially attenuated by the target material, as a result of the heel effect, it may only be necessary to make a portion of the filter 2 millimeters thick, and other portions of the filter may be less than 2 millimeters thick.

As another example, the maximum thickness of a filter should be compatible with dose requirements associated with, for example, computed tomography ("CT") imaging applications. For example, if a filter is too thick, such that excessive attenuation is imparted to the x-rays, the resulting images will be excessively noisy. However, as the thickness of the filter is increased relative to a minimum thickness, the gain flattening effect will be increased, to at least some extent, for a given $KV_P$ energy.

The materials used in the construction of embodiments of the filter, like the filter geometry, may vary widely as well. In general, the material(s) used to construct the filter can be selected with reference to considerations such as the particular application or operating environment in connection with which the filter is to be employed. In filter design a choice of physical geometry including thickness and material (or materials if some geometrical distribution is used) is required. For example, the design may use thickness to achieve a flat intensity and the material or materials may be chosen such that the combination of thickness and material choice achieves both a flat (i.e. more uniform) intensity and the desired beam spectrum shape (hardness) for every path through the filter. Generally, any material or combination of materials which serve to attenuate x-rays can be employed. Examples of such materials include, but are not limited to, aluminum and aluminum alloys, copper, iron, steel, plastics, glass, water and other compounds, mixtures, liquids, tungsten, and doped materials, such as tungsten-filled plastic for example. Also, a flat plastic configuration with a gradiation of metal—i.e. different densities disposed along the length of plastic could be used. In light of the foregoing, it will be appreciated that the terms "attenuation" and "flattening" are used in a manner so as to include the concept of filtering with respect to signal intensity, or spectrum, or both, so as to achieve an x-ray beam that is relatively uniform throughout a substantial portion of the beam profile.

Figure 5B:
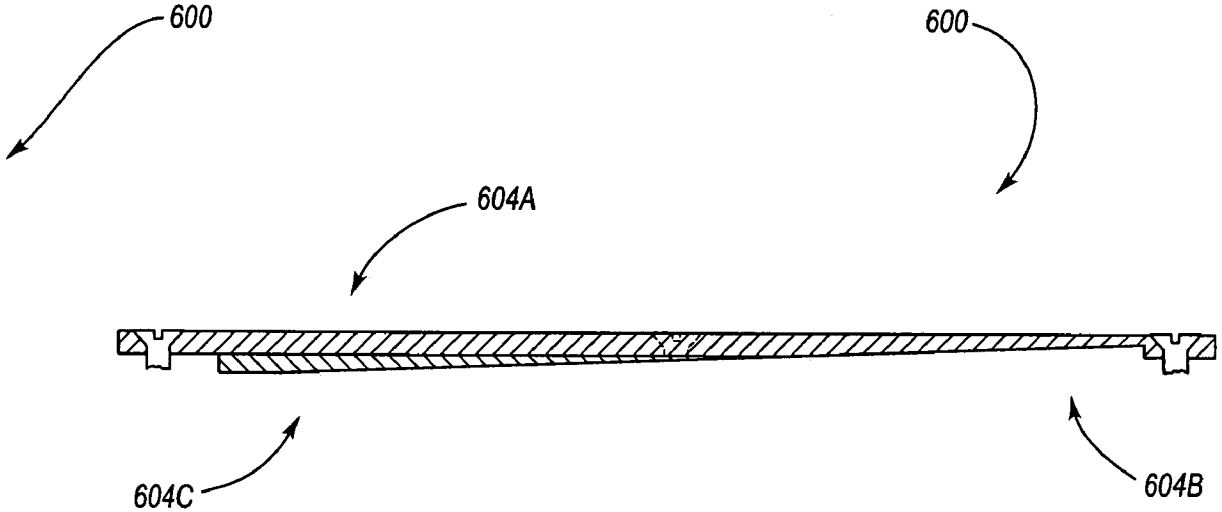
FIG. 5B is a partial section view of the asymmetric flattening filter illustrated in FIG. 5A.
Figure 5A:
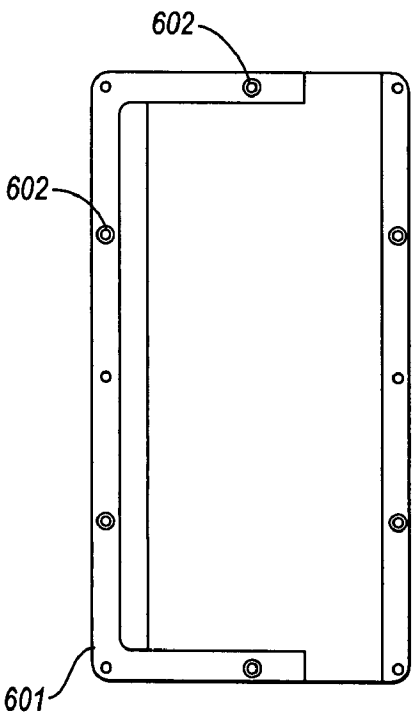
FIG. 5A is a top view of an alternative implementation of an asymmetric flattening filter.

Directing attention now to FIGS. 5A and 5B, details are provided concerning an alternative embodiment of a filter, denoted generally at 600. In terms of its shape, the filter 600 is somewhat similar to the filter 500 illustrated in FIGS. 4A and 4B. However, the filter 600 differs in at least one significant regard, namely, the configuration of the attenuation portions of the filter 600.

In particular, and as best illustrated in FIG. 5B, the filter 600 is substantially polygonal, exemplarily rectangular, and defines or otherwise includes a mounting structure 601 having a plurality of fastener holes 602 to aid in attachment of the filter 600 to a suitable support structure. In the illustrated embodiment, the cross-section of the filter 600 slopes gradually from one edge of the filter to the other, specifically from the relatively thicker attenuation portion 604A to the relatively thinner attenuation portion 604B, so that the filter 600, considered as a whole, is relatively thicker on one side than on the other.

As in the case of the exemplary filter 500, the change in slope or thickness from relatively thicker attenuation portion 604A to the relatively thinner attenuation portion 604B may be accomplished in either a nonlinear or a linear fashion, or using a combination of both. Moreover, as is the case with various other exemplary filters disclosed herein, the particular slope value, or rate of change of thickness of the filter from the relatively thicker attenuation portion 604A to the relatively thinner attenuation portion 604B may be varied as required to suit the requirements of a particular application. Similar to the case of the filter 500, the filter 600 also includes, some embodiments, a supplemental attenuation portion 604C. In some alternative embodiments, the supplemental attenuation portion is omitted.

Figure 6C:
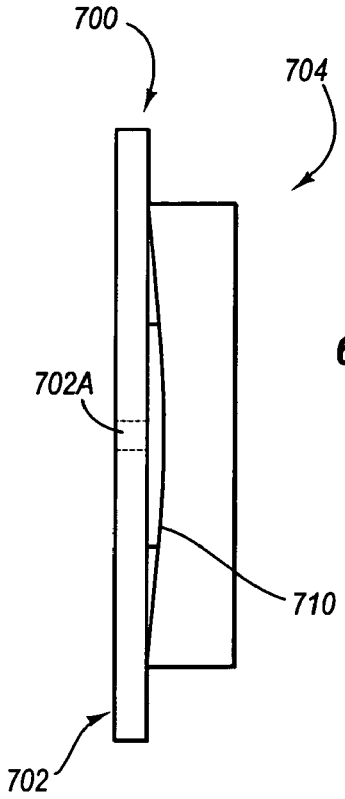
FIG. 6C is an alternative section view of the two dimensional asymmetric flattening filter illustrated in FIG. 6A.
Figure 6A:
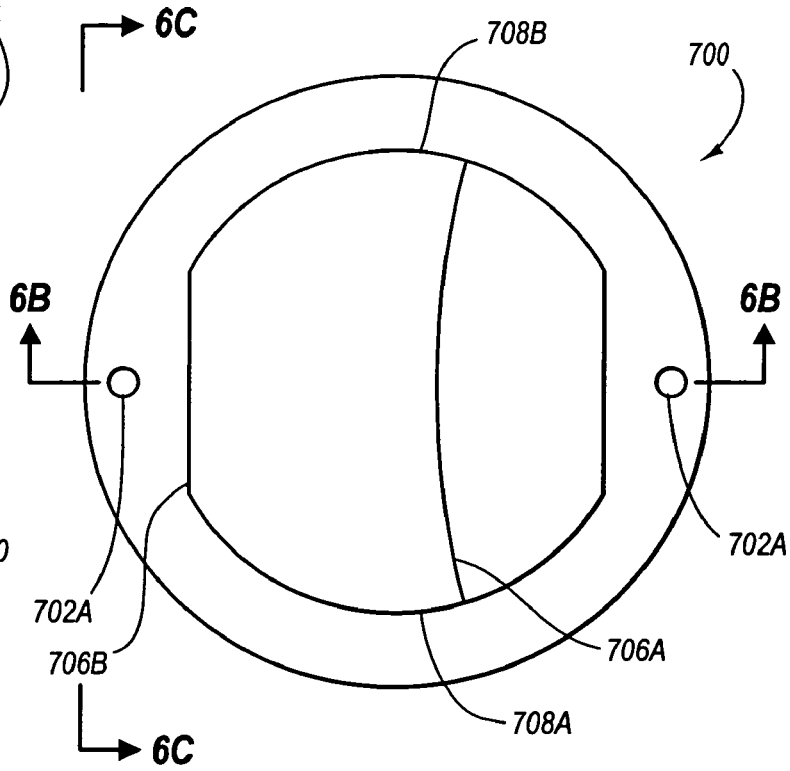
FIG. 6A is a top view of an implementation of a two dimensional asymmetric flattening filter.
Figure 6B:
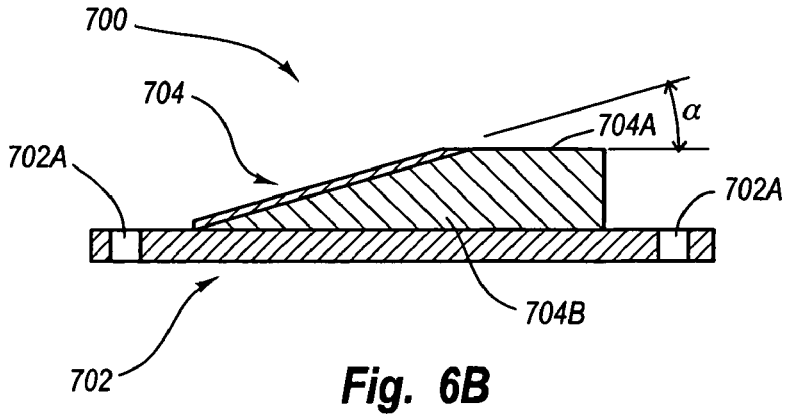
FIG. 6B is a section view of the two dimensional asymmetric flattening filter illustrated in FIG. 6A.

With attention now to FIGS. 6A through 6Cc, details are provided concerning yet another exemplary implementation of a filter, denoted generally at 700, such as may be employed in the attenuation of an x-ray beam. In the illustrated embodiment, the filter 700 includes a base 702 which is substantially circular in the illustrated case, but which may be implemented in any other suitable form as well. The base 702 defines through holes 702A which facilitate attachment of the filter 700 to another structure.

Attached to the base 702 is a wedge structure 704 which, like the base 702, is substantially circular in some implementations. In some cases, the wedge structure 704 and base 702 are discrete structural elements but, in other embodiments, the wedge structure 704 and base 702 are integral with each other. A wedge angle $\alpha$ is defined by the wedge structure 704 and may have any suitable value. In one exemplary case, a wedge angle $\alpha$ of about 16.2 degrees has produced useful results, but the scope of the invention is not so limited.

As indicated in FIG. 6B, the exemplary wedge structure 704 defines a substantially flat upper portion 704A that is contiguous with a slope 704B. The dimensions, arrangement, and relative positioning of the upper portion 704A and the slope 704B may be varied as desired. As in the case of the other exemplary filters disclosed herein, the slope 704B may be linear, so that the slope 704B takes the form of a substantially planar surface, or the slope 704B may be nonlinear, so that the slope 704B takes the form of a substantially nonplanar surface.

With continued reference to FIGS. 6A through 6C, the slope 704B defined by the wedge structure 704 has upper and lower edges 706A and 706B, respectively, as well as first and second side edges 708A and 708B, respectively. In the illustrated embodiment, the upper edge 706A and first and second side edges 708A and 708A are curved, while the lower edge 706B is substantially straight. This is only an exemplary configuration however, and aspects of the geometry of the slope 704B may be varied as desired.

Additionally, the wedge structure 704 is relatively thicker at the upper edge 706A of the slope than at the lower edge 706B of the slope 704B. As best illustrated in FIG. 6C, the exemplary wedge structure 704 is further configured so that the thickness of the wedge varies between the first and second side edges 708A and 708B. In the illustrated embodiment, this variation in thickness occurs gradually, from a minimum at the first and second side edges 708A and 708B to a maximum located at about the center of the slope 704B, and is represented by the profile 710 in FIG. 6C. The curve 710 may be a portion of a circle, or of a parabola. The aforementioned variation in thickness may take other forms as well and is implemented so as to accommodate, for example, a curvature of the x-ray beam profile. As another example, the slope 704B may additionally, or alternatively, describe a curve bounded by upper and lower edges 706A and 706B, respectively.

It should be noted that a slope 704B that incorporates a change in thickness as exemplified by the profile 710 may be referred to herein as having a "two dimensional" form, and filters employing such a geometry may be referred to herein as a "two dimensional filter." The use of this notation refers to the notion that the slope 704B has a nonplanar configuration, which may be at least partially convex, as indicated in FIG. 6C by the profile 710, or at least partially concave (not shown). As noted earlier, such convexity and/or concavity may be oriented in a variety of ways, such as between first and second side edges 708A and 708B, and/or between upper and lower edges 706A and 706B, or in any other suitable fashion. Thus, the scope of the invention should not be construed to be limited to the exemplary disclosed embodiments.

Figure 6D:
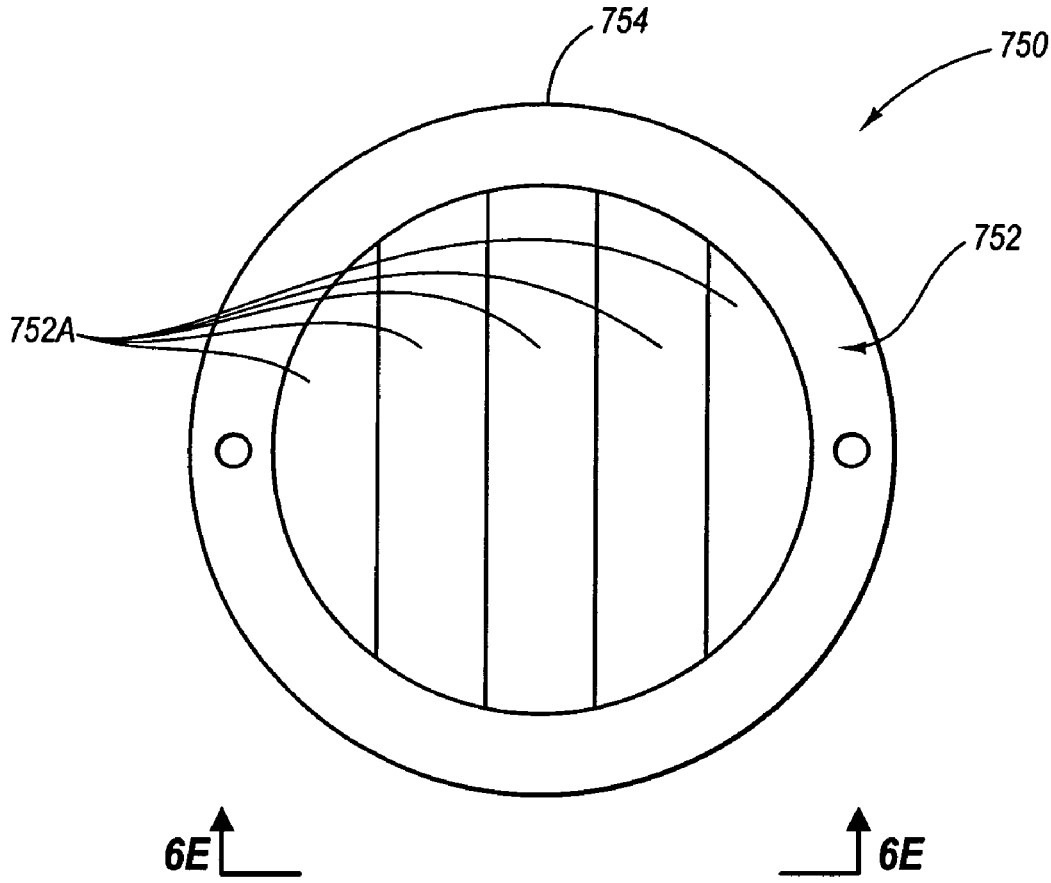
FIG. 6D is a top view of an alternative embodiment of an asymmetric flattening filter.
Figure 6E:
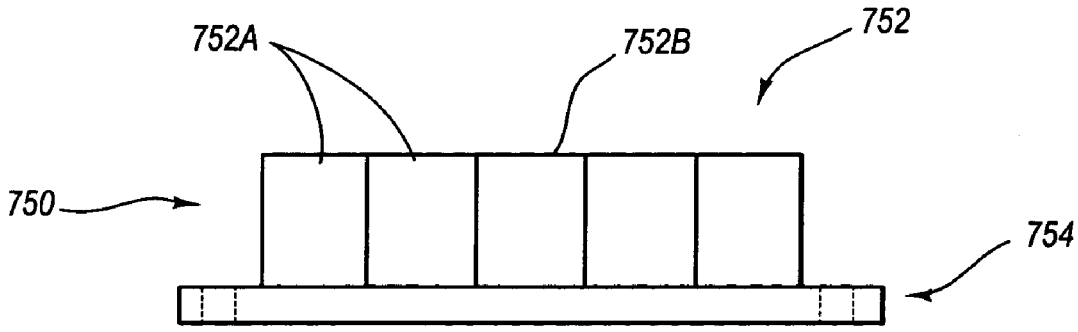
FIG. 6E is a side view of the embodiment of the asymmetric flattening filter illustrated in FIG. 6D.

In one alternative embodiment illustrated in FIGS. 6D and 6E, the wedge structure 704 is omitted and the filter 750 includes a cylindrical section 752 that is mounted atop a base 754 and comprised of a plurality of different pieces 752A, or slices, of material, each having different attenuation characteristics. The slices are attached to each other, such as by welding, brazing or any other suitable process, to form the cylindrical section 752, so that one end of each slice comprises or defines a portion of a top surface 752B of the cylindrical section 752. In this way, the attenuation effect achieved with the cylindrical section 752 varies across the top surface 752B of the cylindrical section 752, so as enable implementation of selective attenuation of an x-ray beam incident upon the top surface 752B. As in the case of the exemplary wedge configuration illustrated in FIGS. 6A through 6C, the top surface 752B may be constructed to include or define a convex or concave portion.

While the different pieces of material in this alternative embodiment may be implemented as slices, the scope of the invention is not so limited. For example, the different pieces of materials may be implemented as concentric sleeves. More generally however, such different pieces of materials can be configured and assembled in any other way that would provide a desired attenuation effect.

Figure 7A:
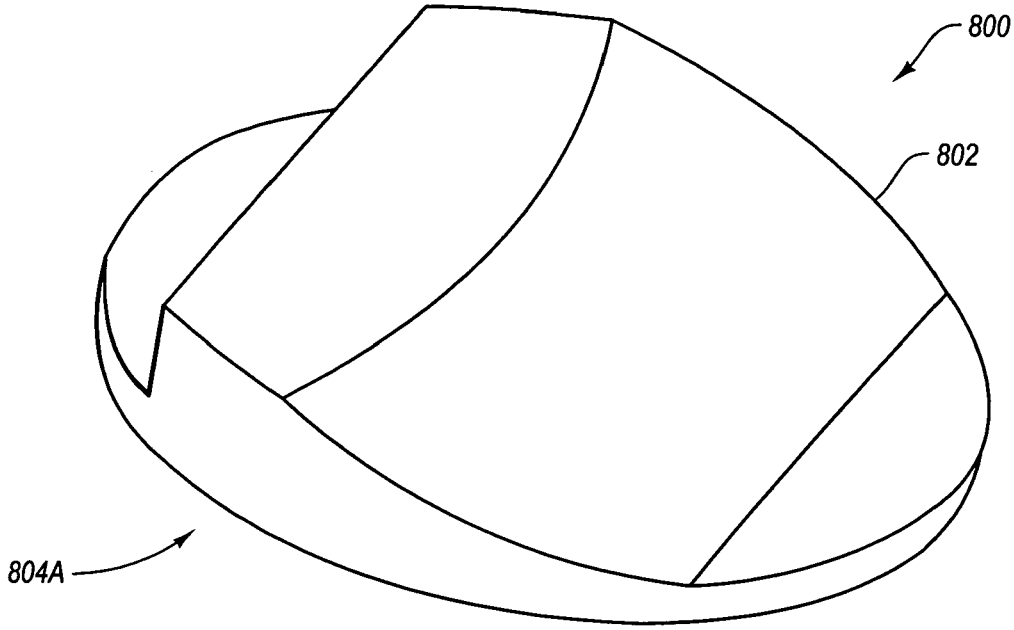
FIG. 7A is a perspective view of a filter form suitable for use in defining a cavity of an alternative embodiment of an asymmetric flattening filter.
Figure 7B:
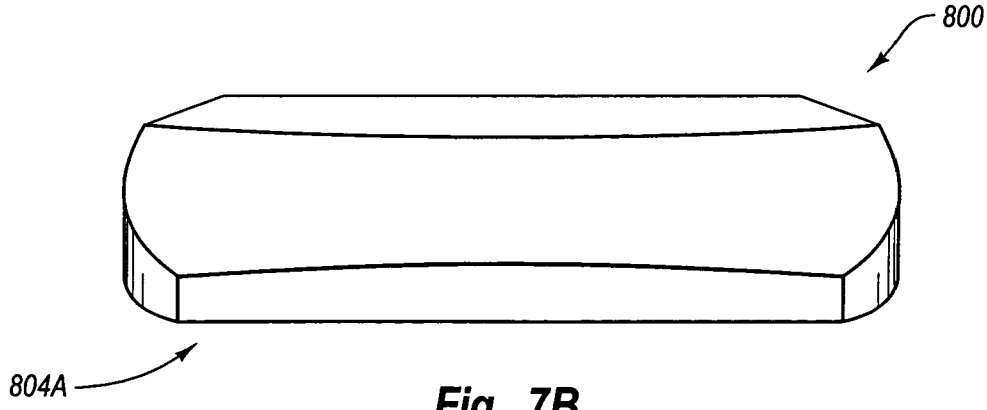
FIG. 7B is a front view of the filter form illustrated in FIG. 7A
Figure 7C:
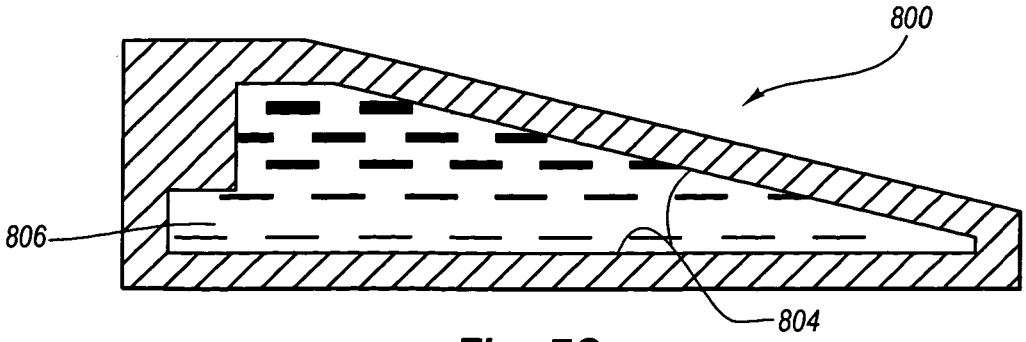
FIG. 7C is a section view of an asymmetric flattening filter that defines a cavity configured as shown in FIGS. 7A and 7B.

Directing attention now to FIGS. 7A through 7C, details are provided concerning aspects of another exemplary filter, denoted generally at 800. Generally, the filter 800 comprises a body 802 which exemplarily takes the form of first and second portions that are joined together so as to define a cavity 804. The body 802 may comprise any suitable material, examples of which include, but are not limited to, aluminum and aluminum alloys, plastics, glass, tungsten, and doped materials such as tungsten-filled plastic.

In at least one implementation, the cavity 804 is substantially in the form of the exemplary wedge structure 804A illustrated in FIGS. 7A and 7B. However, the cavity 804 may be implemented in various other configurations as well. In the illustrated embodiment, the cavity 804 is at least partially filled with an attenuation material 806 which may comprise a liquid, such as water, a liquid metal, or any other materials that are effective in attenuating an x-ray beam or a portion thereof. In at least some cases, the body 802 implements an attenuation functionality as well, so that the total attenuation imparted to an x-ray beam by the filter 800 includes an attenuation component implemented by the body 802 and an attenuation component implemented by the attenuation material 806.

IV. Processes for Asymmetric Flattening of an X-Ray Beam

Figure 8:
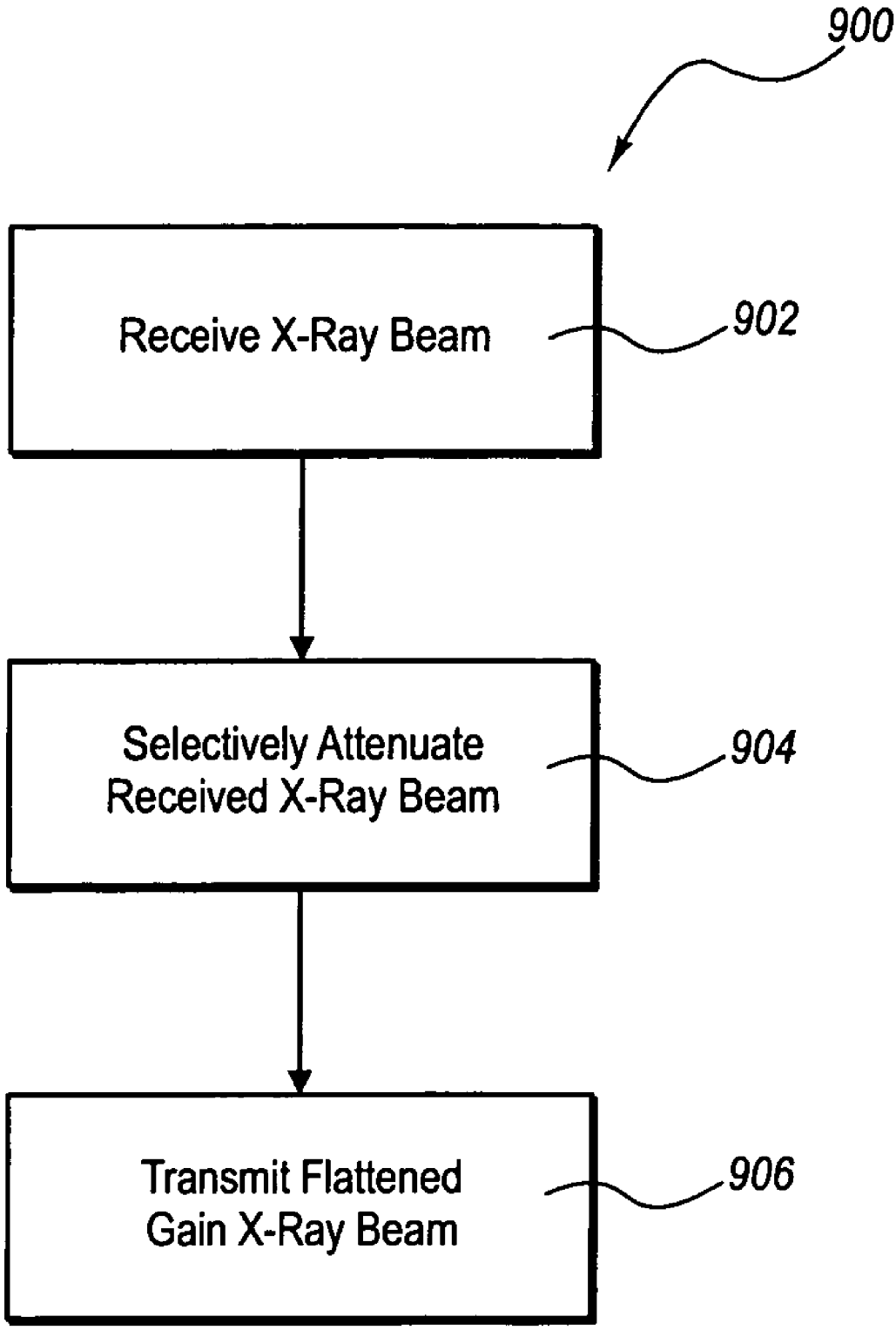
FIG. 8 is a flow diagram illustrating aspects of an exemplary process for asymmetrically flattening an x-ray beam gain profile.

With attention finally to FIG. 8, details are provided an exemplary process 900 for asymmetrically flattening an x-ray beam gain profile. At stage 902 of the process 900, the x-ray beam is received for attenuation. As disclosed herein, the x-ray beam may have already been partially attenuated by a target surface of an anode, such as in connection with the heel effect.

The process 900 then moves to stage 904 where the received x-ray beam is selectively attenuated. In at least one exemplary implementation, this selective attenuation involves attenuating a central portion of the received x-ray beam to a relatively greater extent than a peripheral portion of the received x-ray beam, so as to at least partially overcome a heel effect associated with the received x-ray beam. More generally however, the attenuation process involves relatively greater attenuation of relatively high intensity portions of the x-ray beam, and relatively less attenuation of relatively lower intensity portions of the x-ray beam.

The selective attenuation of the x-ray beam at stage 904 is implemented so as to achieve a desired effect with respect to the flux associated with the x-ray beam. For example, the x-ray beam is attenuated to the extent necessary to achievement of a relative improvement in the uniformity of the x-ray beam and, thus, a relatively flatter gain associated with the x-ray beam profile.

At such time as the x-ray beam has been attenuated to the extent necessary to achieve the foregoing and/or other ends, the process 900 advances to stage 906 where the now-attenuated x-ray beam is transmitted, such as to a patient or other x-ray subject. Due at least in part to the improvement in the flux uniformity of the x-ray beam, the quality of the image ultimately produced with the attenuated beam will be enhanced.

The improvement in flux uniformity as a result of the selective attenuation of the x-ray beam contributes as well to relative improvements in the dynamic range of the associated x-ray device, as well as to increases in the SNR uniformity of the x-ray device. More particularly, the SNR uniformity is enhanced because after gain calibration, which digitally flattens the x-ray flux, the regions with low flux experience higher gain, resulting in decreased SNR.

The described embodiments are to be considered in all respects only as exemplary and not restrictive. The scope of the invention is, therefore, indicated by the appended claims rather than by the foregoing description. All changes which come within the meaning and range of equivalency of the claims are to be embraced within their scope.

What is claimed is:

1. An x-ray device, comprising:

a cathode;

an anode configured and arranged to generate an x-ray beam, the anode including a target surface arranged to receive an electron beam generated by the cathode; and a filter positioned and configured to selectively attenuate the x-ray beam generated by the anode, the filter comprising:

an attenuation portion disposed side-by-side between first and second subsidiary attenuation portions that are each relatively thinner than the attenuation portion, the attenuation portion and the first and second subsidiary attenuation portions being collectively configured in a double taper arrangement where the filter tapers from a relatively greater thickness in the attenuation portion to relatively lesser thicknesses in the first and second subsidiary attenuation portions.

2. The x-ray device as recited in claim 1, wherein the filter is substantially rectangular in shape.

3. The x-ray device as recited in claim 1, further comprising a supplemental attenuation portion disposed proximate the attenuation portion.

4. The x-ray device as recited in claim 1, wherein a portion of a taper from the attenuation portion to one of the subsidiary attenuation portions is substantially linear.

5. The x-ray device as recited in claim 1, wherein a portion of a taper from the attenuation portion to one of the subsidiary portions is substantially non-linear.

6. The x-ray device as recited in claim 1, wherein one portion of the filter is integral with another portion of the filter.

7. The x-ray device as recited in claim 1, wherein one of the attenuation portion, first subsidiary attenuation portion, and second subsidiary attenuation portion is discrete from, but attached to, the other portions.

8. The x-ray device as recited in claim 1, wherein the filter comprises a substantially planar configuration.

9. An x-ray device, comprising:

a cathode;

an anode configured and arranged to generate an x-ray beam, the anode including a target surface arranged to receive an electron beam generated by the cathode; and a filter positioned and configured to selectively attenuate the x-ray beam generated by the anode, the filter comprising:

a base; and a wedge structure disposed on the base and defining a sloped surface that extends from an upper portion of the wedge structure to a lower portion of the wedge structure, and the wedge structure further being tapered from a middle portion of the wedge structure to first and second edges disposed on either side of the middle portion such that the wedge structure is relatively thicker in the middle portion than at the edges.

10. The x-ray device as recited in claim 9, wherein the sloped surface intersects a substantially flat upper surface of the wedge structure, and a thickness of the wedge structure varying from a relative maximum near the substantially flat upper surface to a relative minimum near the base.

11. The x-ray device as recited in claim 9, wherein a portion of a taper from the middle portion to one of the edges is substantially non-linear.

12. The x-ray device as recited in claim 9, wherein a portion of a taper from the middle portion to one of the edges is substantially linear.

13. The x-ray device as recited in claim 9, wherein the wedge structure substantially comprises at least one of plastic; glass; and, metal.

14. The x-ray device as recited in claim 9, wherein at least a portion of the slope of the wedge structure is substantially linear.

15. The x-ray device as recited in claim 9, wherein at least a portion of the slope of the wedge structure is substantially nonlinear.

16. The x-ray device as recited in claim 9, wherein the sloped surface includes a portion that is substantially nonplanar.

17. The x-ray device as recited in claim 9, wherein the sloped surface includes a portion that is substantially planar.

* * * * *